US011111794B2

(12) United States Patent
Bitzko et al.

(10) Patent No.: US 11,111,794 B2
(45) Date of Patent: Sep. 7, 2021

(54) FEATHER SEALS WITH LEAKAGE METERING

(71) Applicant: United Technologies Corporation, Farmington, CT (US)

(72) Inventors: David Bitzko, West Palm Beach, FL (US); Shawn M. McMahon, West Hartford, CT (US); Alex J. Schneider, South Glastonbury, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 88 days.

(21) Appl. No.: 16/267,799

(22) Filed: Feb. 5, 2019

(65) Prior Publication Data

US 2020/0248566 A1 Aug. 6, 2020

(51) Int. Cl.

| | |
|---|---|
| ***F01D 5/18*** | (2006.01) |
| ***F01D 9/06*** | (2006.01) |
| ***F01D 25/08*** | (2006.01) |

(52) U.S. Cl.

CPC ..... *F01D 5/187* (2013.01); *F01D 9/065* (2013.01); *F01D 25/08* (2013.01)

(58) Field of Classification Search

CPC ..... F01D 5/187; F01D 5/188; F01D 5/189; F01D 5/148

USPC ..... 415/139

See application file for complete search history.

(56) References Cited

U.S. PATENT DOCUMENTS

| | | | | |
|---|---|---|---|---|
| 4,767,260 | A | 8/1988 | Clevenger et al. | |
| 7,600,967 | B2 * | 10/2009 | Pezzetti, Jr. | F01D 11/005 415/115 |
| 9,869,201 | B2 * | 1/2018 | Dyson | F01D 25/12 |
| 10,030,529 | B2 | 7/2018 | Bergman et al. | |
| 10,633,994 | B2 * | 4/2020 | Barker | F01D 11/005 |
| 2012/0189424 | A1 | 7/2012 | Propheter-Hinckley et al. | |
| 2013/0028713 | A1 * | 1/2013 | Giri | F16J 15/064 415/135 |

FOREIGN PATENT DOCUMENTS

| | | | | |
|---|---|---|---|---|
| DE | 10306915 | A1 | 9/2004 | |
| EP | 2180143 | A1 | 4/2010 | |
| EP | 2551562 | A2 | 1/2013 | |
| EP | 2551562 | A3 | 12/2013 | |
| EP | 3034805 | A1 * | 6/2016 | F01D 9/041 |
| EP | 3284913 | A1 | 2/2018 | |
| WO | 2018004583 | A1 | 1/2018 | |

OTHER PUBLICATIONS

European Search Report dated Apr. 9, 2020, received for corresponding European Application No. 20155234.6, 5 pages.

* cited by examiner

*Primary Examiner* — Courtney D Heinle
*Assistant Examiner* — Michael K. Reitz
(74) *Attorney, Agent, or Firm* — Kinney & Lange, P.A.

(57) ABSTRACT

A seal assembly includes a first feather seal with a first cooling hole extending through the first feather seal. The seal assembly also includes a second feather seal adjacent to the first feather seal. The second feather seal includes a second cooling hole extending through the second feather seal. The first cooling hole is positioned over at least a portion of the second cooling hole.

6 Claims, 8 Drawing Sheets

FEATHER SEALS WITH LEAKAGE METERING

BACKGROUND

The present disclosure relates to gas turbine engines, and in particular, to an intersegment seal assembly.

Feather seals are commonly used in aerospace and other industries to provide a seal between two adjacent components. For example, gas turbine engine vanes are arranged in a circumferential configuration to form an annular vane ring assembly about a center axis of the gas turbine engine. Typically, each stator segment includes an airfoil and a platform section. When assembled, the platforms abut and define a radially inner and radially outer boundary to a core flow path.

The edge of each platform includes a channel which receives a feather seal assembly that seals the hot gas core flow from a surrounding medium, such as a cooling airflow. The edges of the platform that are exposed to the hot gas core flow require cooling to reduce wear and corrosion. In the past, cooling holes have been formed in the edges of the platform that direct cooling air from a passage inside the vane to the edges. These cooling holes can be difficult and expensive to form.

SUMMARY

In aspect of the disclosure, an assembly for a gas turbine engine that includes a first component and a second component adjacent to the first component. The first component and the second component each include a body having two circumferential sides, a leading end, and a trailing end. One of the circumferential sides of the first component is adjacent one of the circumferential sides of the second component, and the circumferential sides each include a seal channel. A first feather seal is inside the seal channel between the first component and the second component and includes first cooling hole extending through the first feather seal. A second feather seal is inside the seal channel between the first component and the second component and is adjacent to the first feather seal. The second feather seal includes a second cooling hole extending through the second feather seal. The first cooling hole is positioned over at least a portion of the second cooling hole.

The assembly of the preceding paragraph can optionally include, additionally and/or alternatively, any one or more of the following features, configurations and/or additional components:

the first component is a platform of a first vane segment and the second component is a platform of a second vane segment;

the first component is a first segment of a blade outer air seal and the second component is a second segment of the blade outer air seal;

the first component is a platform of a first blade segment and the second component is a platform of a second blade segment;

the first cooling hole is an elongated slot;

the second cooling hole is an elongated slot that is non-parallel with the first cooling hole;

the second cooling hole is a circular hole;

a third cooling hole is formed in the second feather seal, and wherein the first cooling hole extends over a portion of the second and third cooling holes; and/or a fourth cooling hole is formed in the first feather seal, and wherein the fourth cooling hole extends over a portion of the second and third cooling holes.

In another aspect of the disclosure, a seal assembly includes a first feather seal with a first cooling hole extending through the first feather seal. The seal assembly also includes a second feather seal adjacent to the first feather seal. The second feather seal includes a second cooling hole extending through the second feather seal. The first cooling hole is positioned over at least a portion of the second cooling hole.

The seal assembly of the preceding paragraph can optionally include, additionally and/or alternatively, any one or more of the following features, configurations and/or additional components:

the second feather seal comprises a plurality of cooling holes, and wherein the first cooling hole extends over at least a portion of each cooling hole in the plurality of cooling holes;

the first cooling hole is an elongated slot with a length that extends along a length of the first feather seal;

the second cooling hole is an elongated slot with a length that extends along a width of the second feather seal;

the first cooling hole is an elongated slot and the second cooling hole is an elongated slot, and wherein the first cooling hole is non-parallel with the second cooling hole; and/or the first cooling hole is longer in length than the second cooling hole.

In another aspect of the disclosure, a seal assembly for a gas turbine engine includes a first feather seal with a first cooling hole extending through the first feather seal. The seal assembly also includes a second feather seal adjacent to the first feather seal. The second feather seal includes a second cooling hole extending through the second feather seal. The first cooling hole extends over at least a portion of the second cooling hole, and a perimeter of the first cooling hole is larger than a perimeter of the second cooling hole.

The seal assembly of the preceding paragraph can optionally include, additionally and/or alternatively, any one or more of the following features, configurations and/or additional components:

the first cooling hole is an elongated slot;

the second cooling hole is an elongated slot that is non-parallel with the first cooling hole;

the second cooling hole is a circular hole; and/or the first cooling hole is a circular hole and the second cooling hole is a circular hole with a smaller diameter than the first cooling hole.

Persons of ordinary skill in the art will recognize that other aspects and embodiments of the present invention are possible in view of the entirety of the present disclosure, including the accompanying figures.

Figure 1:
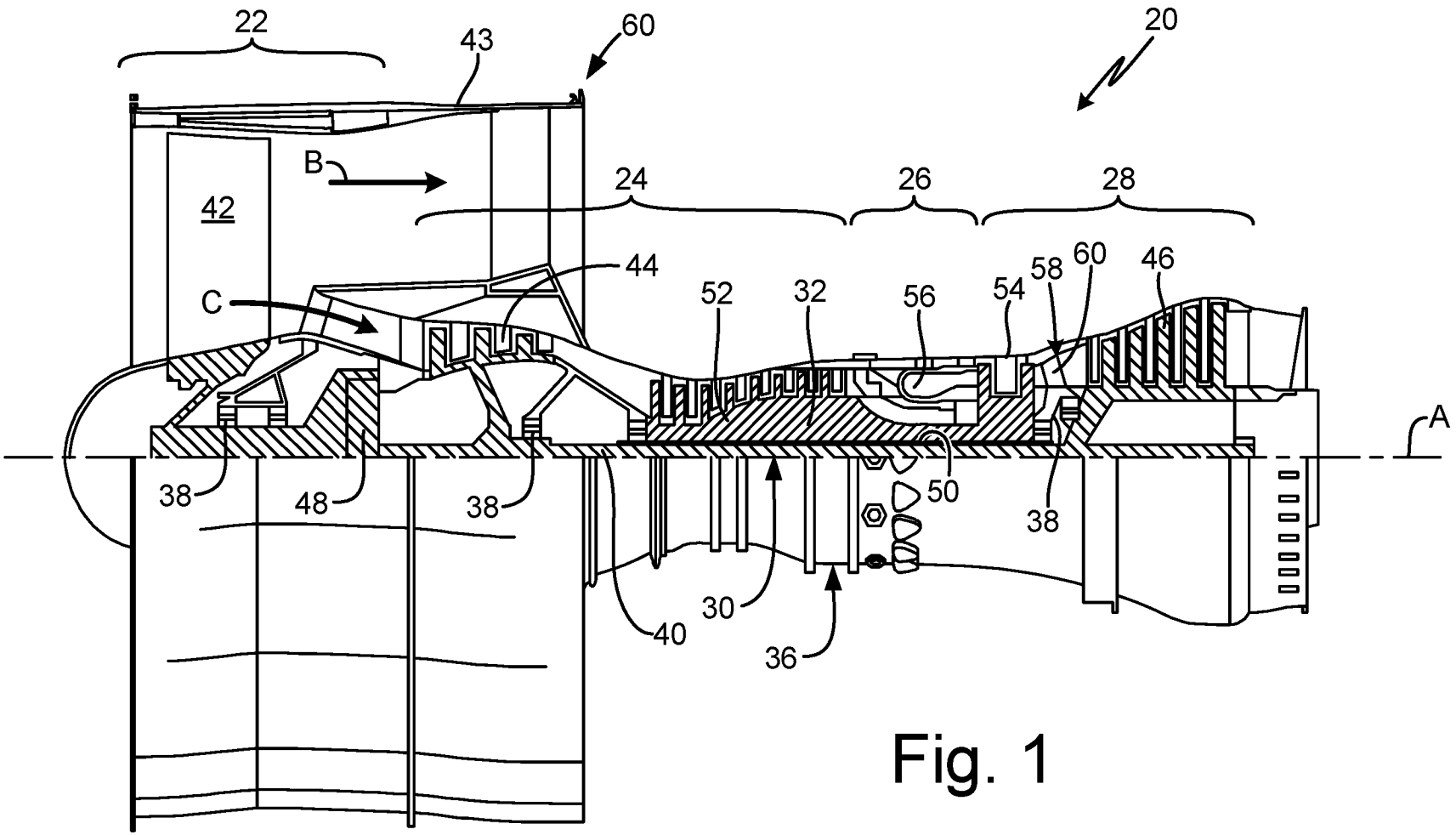
FIG. 1 is a partial cross-sectional view of a gas turbine engine.

While the above-identified drawing figures set forth one or more embodiments of the invention, other embodiments are also contemplated. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings. Like reference numerals identify similar structural elements.

DETAILED DESCRIPTION

This disclosure relates to a seal assembly that allows metered cooling flow across the seal assembly. The seal assembly includes two feather seals stacked together. The first feather seal includes a first cooling hole, and the second feather seal includes a second cooling hole. The first cooling hole extends over at least a portion of the second cooling hole to provide a cooling air pathway across the seal assembly. The geometry and/or orientation of the first cooling hole is different from the second cooling hole such that the cooling air pathway across the seal assembly is not restricted or closed should the first feather seal shift relative the second feather seal. The seal assembly is discussed below with reference to the figures.

FIG. 1 is a quarter-sectional view that schematically illustrates example gas turbine engine 20 that includes fan section 22, compressor section 24, combustor section 26 and turbine section 28. Alternative engines might include an augmenter section (not shown) among other systems or features. Fan section 22 drives air along bypass flowpath B while compressor section 24 draws air in along core flowpath C where air is compressed and communicated to combustor section 26. In combustor section 26, air is mixed with fuel and ignited to generate a high pressure exhaust gas stream that expands through turbine section 28 where energy is extracted and utilized to drive fan section 22 and compressor section 24.

Although the disclosed non-limiting embodiment depicts a turbofan gas turbine engine, it should be understood that the concepts described herein are not limited to use with turbofans as the teachings may be applied to other types of turbine engines; for example, an industrial gas turbine; a reverse-flow gas turbine engine; and a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example gas turbine engine 20 generally includes low speed spool 30 and high speed spool 32 mounted for rotation about center axis A of gas turbine engine 20 relative to engine static structure 36 via several bearing systems 38. It should be understood that various bearing systems 38 at various locations may alternatively or additionally be provided.

Low speed spool 30 generally includes inner shaft 40 that connects fan 42 and low pressure (or first) compressor section 44 to low pressure (or first) turbine section 46. Inner shaft 40 drives fan 42 through a speed change device, such as geared architecture 48, to drive fan 42 at a lower speed than low speed spool 30. High-speed spool 32 includes outer shaft 50 that interconnects high pressure (or second) compressor section 52 and high pressure (or second) turbine section 54. Inner shaft 40 and outer shaft 50 are concentric and rotate via bearing systems 38 about center axis A.

Combustor 56 is arranged between high pressure compressor 52 and high pressure turbine 54. In one example, high pressure turbine 54 includes at least two stages to provide double stage high pressure turbine 54. In another example, high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about 5. The pressure ratio of the example low pressure turbine 46 is measured prior to an inlet of low pressure turbine 46 as related to the pressure measured at the outlet of low pressure turbine 46 prior to an exhaust nozzle.

Mid-turbine frame 58 of engine static structure 36 can be arranged generally between high pressure turbine 54 and low pressure turbine 46. Mid-turbine frame 58 further supports bearing systems 38 in turbine section 28 as well as setting airflow entering the low pressure turbine 46.

The gas flow in core flowpath C is compressed first by low pressure compressor 44 and then by high pressure compressor 52 mixed with fuel and ignited in combustor 56 to produce high speed exhaust gases that are then expanded through high pressure turbine 54 and low pressure turbine 46. Mid-turbine frame 58 includes vanes 60, which are in the core flowpath and function as an inlet guide vane for low pressure turbine 46.

Figure 2:
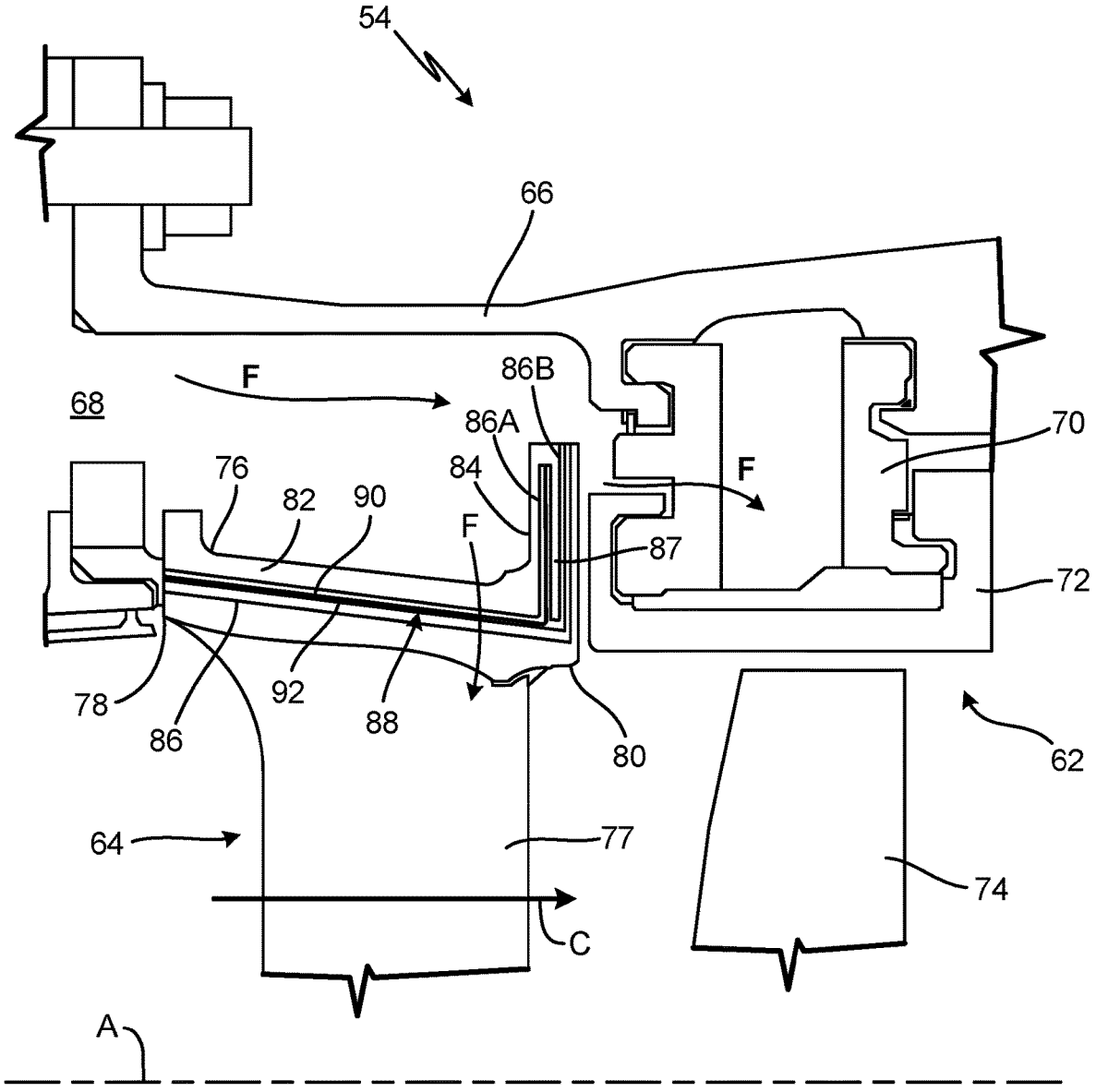
FIG. 2 is a cross-sectional view of a vane stage and a rotor stage of a high pressure turbine section of the gas turbine engine from FIG. 1.
Figure 3:
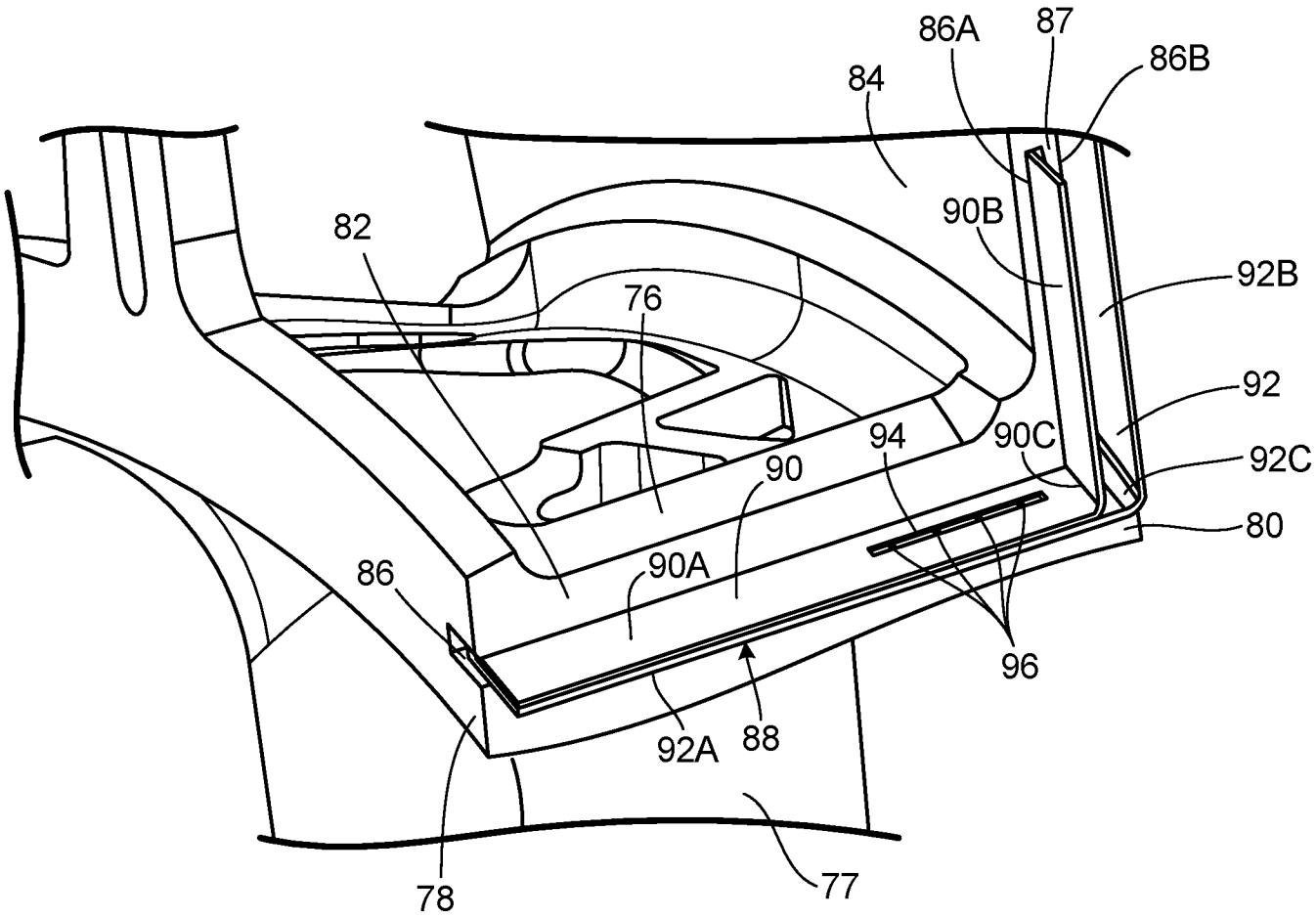
FIG. 3 is a perspective view of a vane segment with a seal assembly that includes a first feather seal and a second feather seal.

FIGS. 2 and 3 will be discussed concurrently. FIG. 2 is a cross-sectional view of high pressure turbine section 54 with rotor assembly 62 and vane assembly 64. FIG. 3 is a perspective view of one segment of vane assembly 64. As shown in FIG. 2, vane assembly 64 is positioned upstream from rotor assembly 62. Core casing 66 is disposed around both rotor assembly 62 and vane assembly 64 and is spaced radially from rotor assembly 62 and vane assembly 64 to form plenum 68. Cooling airflow F can be directed through plenum 68 to cool the components of high pressure turbine section 54. Cooling airflow F travels through plenum 68 at pressures higher than the pressure of the hot combustion gases in the core flowpath C.

Rotor assembly 62 includes mounting structure 70, blade outer air seal (BOAS) 72, and turbine blades 74 (only one of which is shown in FIG. 2). Mounting structure 70 connects BOAS 72 to core casing 66 and spaces BOAS 72 relative turbine blades 74. BOAS 72 and mounting structure 70 are static components that do not rotate about center axis A. BOAS 72 forms an outer diameter endwall for the portion of core flowpath C in rotor assembly 62. BOAS 72 is cooled by cooling airflow F, thereby allowing BOAS 72 to withstand the high temperatures of the hot combustion gases exiting combustor 56 (shown in FIG. 1). BOAS 72 can be divided into a plurality of segments (only one of which is shown in FIG. 2) that are assembled into a ring that extends around center axis A.

As shown in FIGS. 2 and 3, vane assembly 64 includes vane outer diameter (OD) platform 76 and at least one airfoil 77 extending from vane OD platform 76 toward center axis A. Vane OD platform 76 is positioned radially outward from center axis A and can be aligned with BOAS 72. Vane OD platform 76 is a static component that does not rotate about center axis A. Vane OD platform 76 forms the outer diameter flowpath across vane assembly 64 to direct combustion gases from combustor 56 to rotor assembly 62. Vane OD platform 76 and airfoils 77 are divided into a plurality of segments (only one of which is shown in FIGS. 2 and 3) that are assembled together to form an annular rind around center axis A. Each segment of vane OD platform 76 can be connected to one or more airfoils 77.

Each segment of vane OD platform 76 includes leading end 78, aft end 80, two circumferential side surfaces 82 (only one of which is shown), aft rail 84, and channel 86. Channel 86 includes first branch 86A and second branch 86B. Seal assembly 88 is disposed in channel 86 and includes first feather seal 90 and second feather seal 92. First feather seal 90 includes axial portion 90A, radial portion 90B, and elbow 90C. Second feather seal 92 includes axial portion 92A, radial portion 92B, and elbow 90C. As shown in FIG. 3, first feather seal 90 further includes first cooling hole 94, and second feather seal 92 includes additional cooling holes 96.

Each segment of vane OD platform 76 extends axially from leading end 78 to aft end 80 and extends circumferentially between the circumferential side surfaces 82. Aft rail 84 extends radially outward from aft end 80 of vane OD platform 76. Channel 86 is formed on each of circumferential side surfaces 82. Channel 86 extends axially on circumferential side surface 82 from leading end 78 toward aft end 80. Proximate aft end 80, channel 86 splits into first branch 86A and second branch 86B. Both first branch 86A and second branch 86B of channel 86 extending radially outward on circumferential side surface 82 and aft rail 84. Second branch 86B is axially spaced from first branch 86A and is aft of first branch 86A so as to form gap 87 between first branch 86A and second branch 86B. Channel 86 extends circumferentially into vane OD platform to receive a portion of both first feather seal 90 and second feather seal 92.

First feather seal 90 and second feather seal 92 are both thin strips of flat metal sheet. First feather seal 90 and second feather seal 92 can both be formed from cobalt alloy or any other metal or material capable of withstanding the high temperatures and stresses present in high pressure turbine section 54 during operation of gas turbine engine 20. First feather seal 90 is received in channel 86 such that axial portion 90A extends from leading end 78 to elbow 90C, and radial portion 90B extends radially outward from elbow 90C in first branch 86A. Second feather seal 92 is received in channel 86 such that axial portion 92A extends from leading end 78 to elbow 92C, and radial portion 92B extends radially outward from elbow 92C in second branch 86B of channel 86. As shown in both FIGS. 2 and 3, axial portion 90A of first feather seal 90 abuts and is adjacent to axial portion 92A of second feather seal 92. Axial portion 90A of first feather seal 90 is radially outward of axial portion 92A of second feather seal 92 and covers most of axial portion 92A. Radial portion 92B and elbow 92C of second feather seal 92 are spaced axially aft of radial portion 90B and elbow 90C of first feather seal 90 with gap 87 being formed between radial portion 90B and radial portion 92B.

When the segment of vane OD platform 76 shown in FIG. 3 is assembled with a second segment (not shown) of vane OD platform 76, a portion of both first feather seal 90 and second feather seal 92 is received in channel 86 of the second segment to close the space between the two segments and prevent cooling airflow F from leaking uncontrolled between the two segments and into core flowpath C. Together, radial portion 90B of first feather seal 90, gap 87 and radial portion 92B of second feather seal 92 provide an effective seal between the two segments at aft rail 84. First cooling hole 94 of first feather seal 90 and cooling holes 96 of second feather seal 92 do allow metered cooling flow across seal assembly 88 to cool the space between the two vane OD platform 76 segments that are exposed to core flowpath C. Cooling the space between the two OD platform 76 segments reduces thermal corrosion and damage to vane assembly 64 during engine operation and thereby increases the operating life of vane assembly 64. First cooling hole 94 of first feather seal 90 and cooling holes 96 of second feather seal 92 are discussed in detail below with reference to FIGS. 4A and 4B.

Figure 4B:
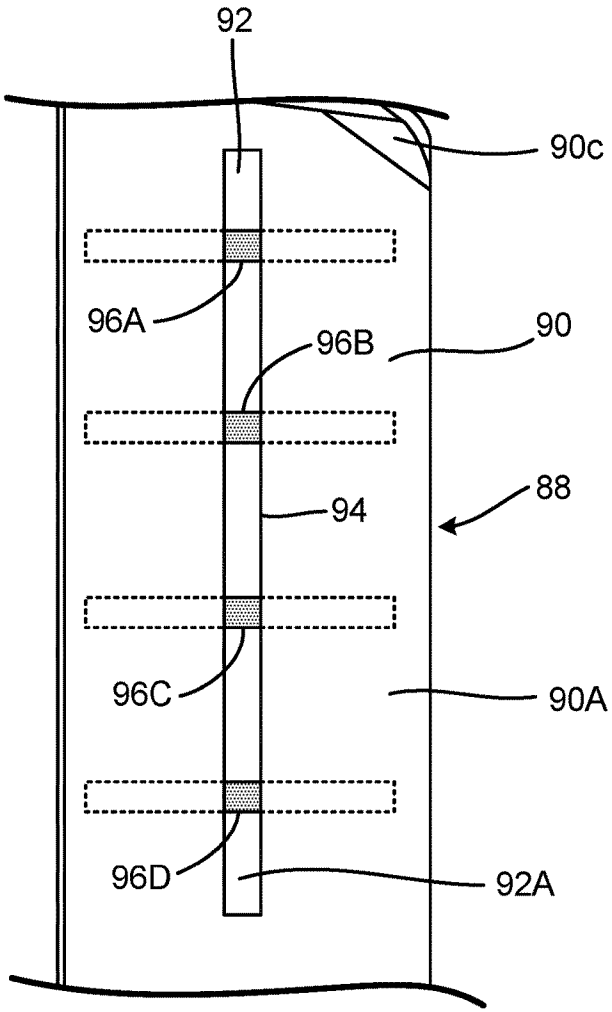
FIG. 4B is a top elevation view of the seal assembly from FIG. 4A.
Figure 4A:
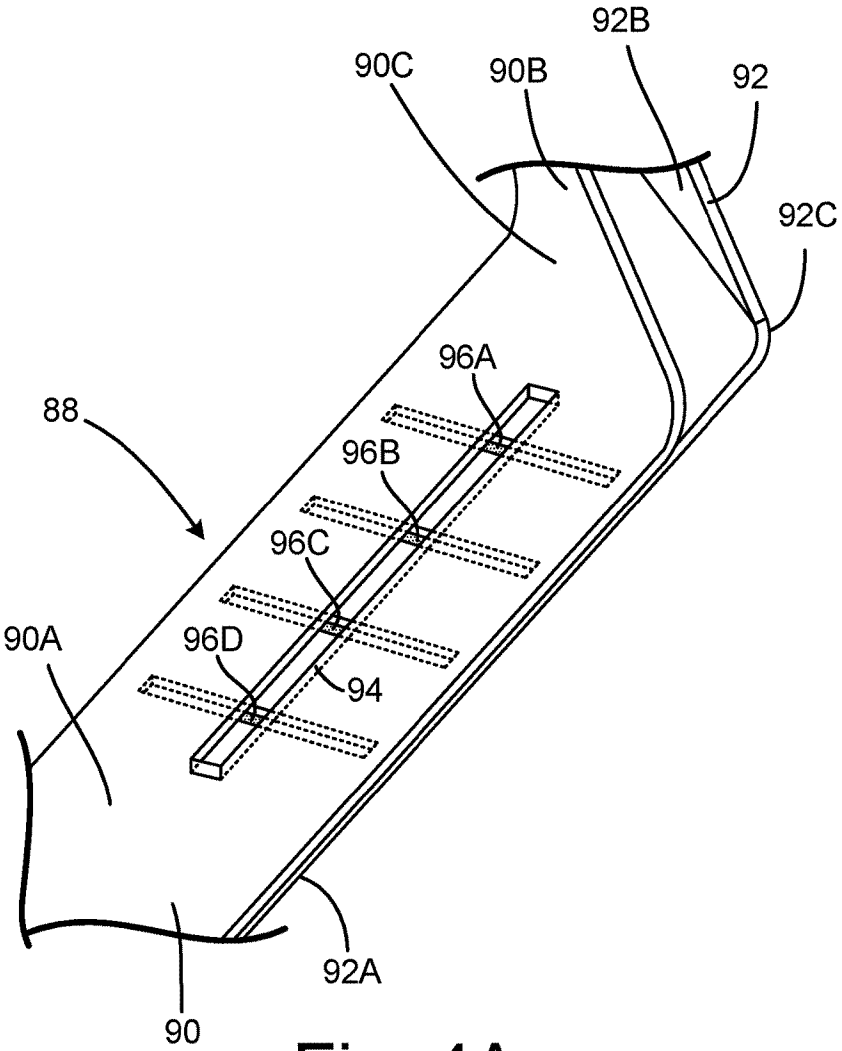
FIG. 4A is a perspective view of the seal assembly from FIG. 3.

FIG. 4A is a perspective view of the embodiment of seal assembly 88 from FIG. 3. FIG. 4B is a top elevation view of seal assembly 88 from FIG. 4A. As shown in FIGS. 4A and 4B, first cooling hole 94 is an elongated slot formed in axial portion 90A of first feather seal 90 and that extends axially relative center axis A (shown in FIG. 2). First cooling hole 94, as embodied in FIGS. 4A and 4B, is centered widthwise on axial portion 90A. Cooling holes 96 of second feather seal 92 include four cooling holes 96A, 96B, 96C, and 96D, with each of the four cooling holes 96A, 96B, 96C, and 96D being formed on axial portion 92A of feather seal 92. The four cooling holes 96A, 96B, 96C, and 96D are each an elongated slot that extends in the widthwise direction or circumferential direction relative center axis A (shown in FIG. 2) and orthogonal to first cooling hole 94. Each of the four cooling holes 96A, 96B, 96C, and 96D is individually shorter in length than first cooling hole 94 and has a smaller perimeter than first cooling hole 94. When first feather seal 90 and second feather seal 92 are assembled together, first cooling hole 94 is sufficiently long enough to extend over a portion of each of the four cooling holes 96A, 96B, 96C, and 96D. As first cooling hole 94 and the four cooling holes 96A, 96B, 96C, and 96D are all elongated slots, the flow area through first cooling hole 94 and the four cooling holes 96A, 96B, 96C, and 96D does not change significantly should first feather seal 90 shift axially or circumferentially relative second feather seal 92 inside channel 86 (shown in FIGS. 2 and 3). Thus cooling airflow F can flow through seal assembly 88 without choking regardless if first feather seal 90 or second feather seal 92 shifts circumferentially and/or axially within channel 86. FIGS. 5A-FIG. 10 show various additional embodiments of the cooling holes of first feather seal 90 and second feather seal 92.

Figure 5A:
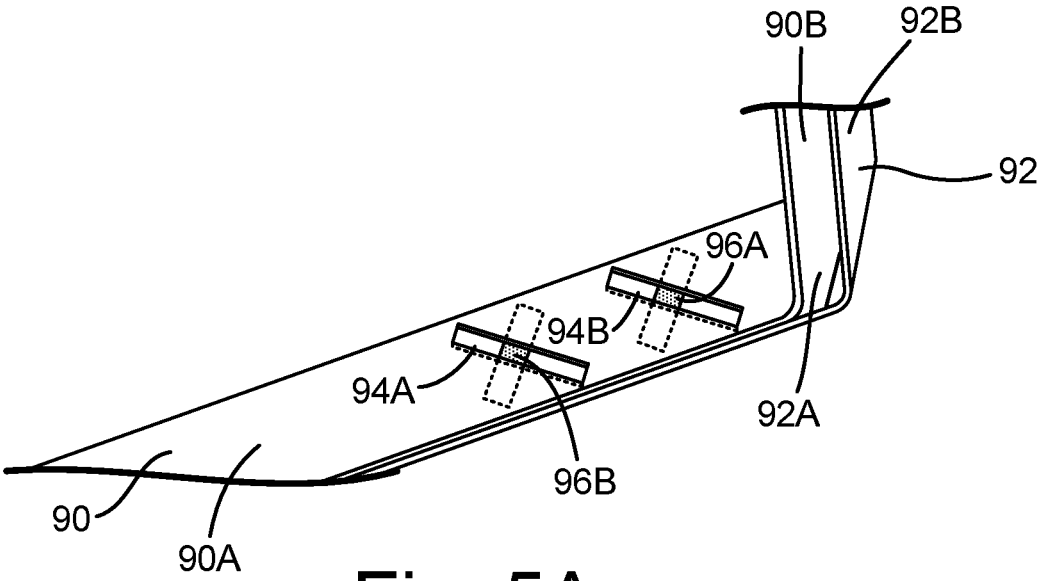
FIG. 5A is a perspective view of another embodiment of the seal assembly with a first feather seal and a second feather seal.
Figure 5B:
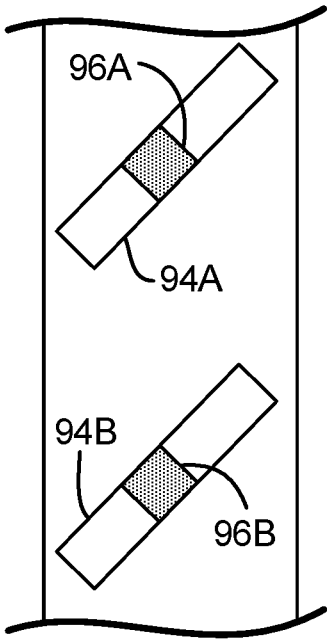
FIG. 5B is a top elevation view of the seal assembly from FIG. 5A with the first feather seal in a nominal position relative the second feather seal.
Figure 5C:
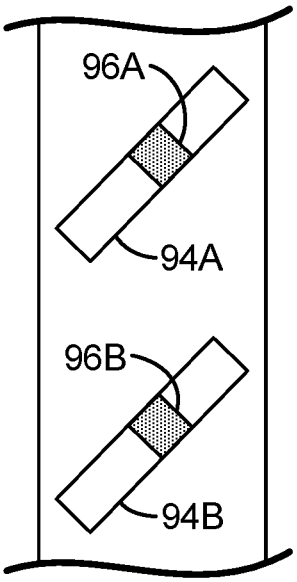
FIG. 5C is another top elevation view of the seal assembly from FIG. 5A with the first feather seal shifted axially relative the second feather seal.
Figure 5D:
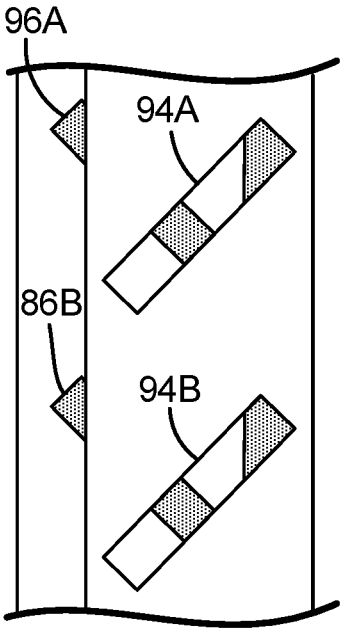
FIG. 5D is another top elevation view of the seal assembly from FIG. 5A with the first feather seal shifted circumferentially relative the second feather seal.

In the embodiment of FIGS. 5A through 5D, first feather seal 90 includes two cooling holes 94A and 94B formed in axial portion 90A. Second feather seal 92 includes two cooling holes 96A and 96B. Cooling holes 94A, 94B, 96A, and 96B are all elongated slots. Cooling holes 94A and 94B of first feather seal 90 are non-parallel to cooling holes 96A and 96B of second feather seal 92. Cooling hole 94A is positioned over cooling hole 96A. Cooling hole 94B is positioned over cooling hole 96B. FIGS. 5A and 5B show first feather seal 90 in a nominal position over second feather seal 92. FIG. 5C shows first feather seal 90 shifted axially relative to second feather seal 92. FIG. 5D shows first feather seal 90 shifted circumferentially relative second feather seal 92. In each instance represented by FIGS. 5A-5D, the flow area across first feather seal 90 and second feather seal 92 does not decrease.

Figure 6B:
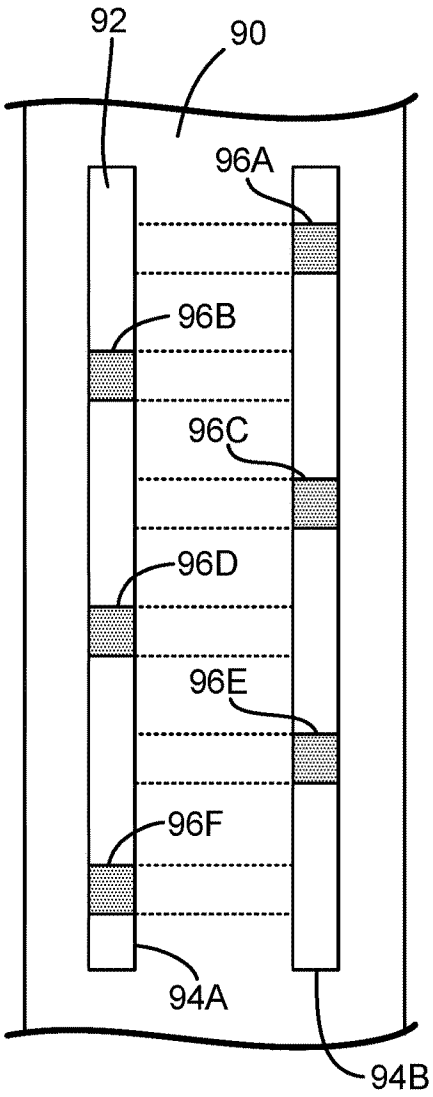
FIG. 6B is a top elevation view of the seal assembly of FIG. 6A.
Figure 6A:
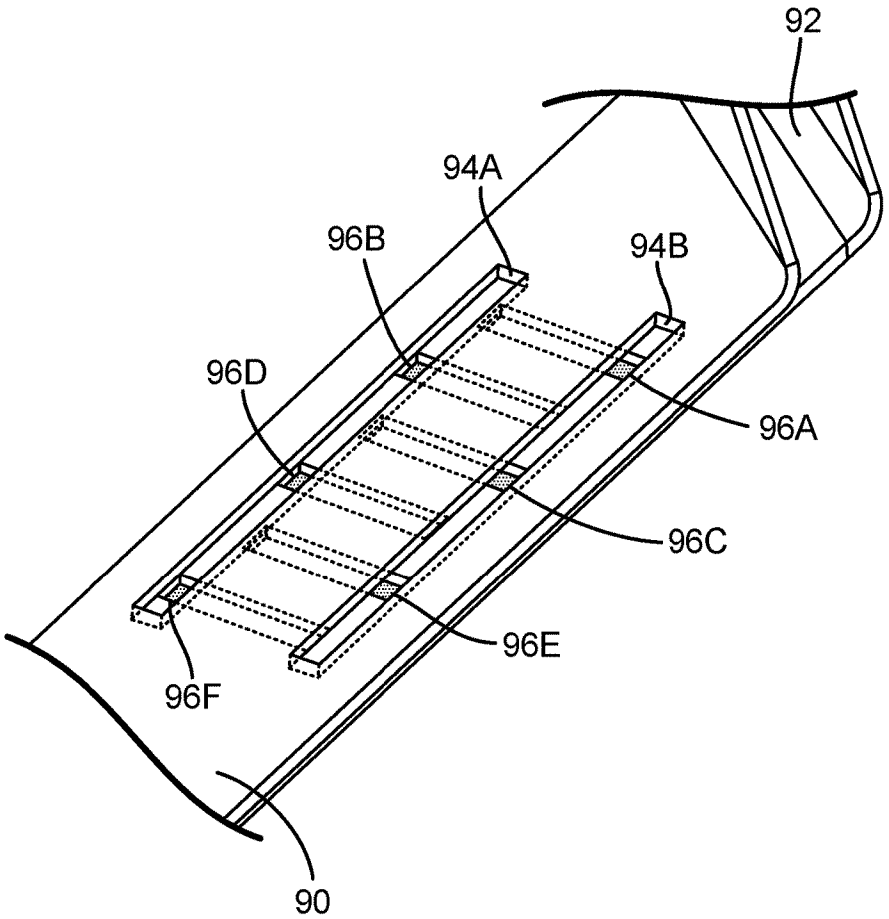
FIG. 6A is a perspective view of another embodiment of the seal assembly.

FIGS. 6A and 6B show another embodiment of first feather seal 90 and second feather seal 92. In the embodiment of FIGS. 6A and 6B, first feather seal 90 includes two cooling holes 94A and 94B that are elongated axially-extending slots that are spaced widthwise from each other. Second feather seal 92 includes six cooling holes 96A-96F. Cooling holes 96A-96F are elongated slots that each have a length extending in the direction of the width of second feather seal 92. In the embodiment of FIGS. 6A and 6B, the position of cooling holes 96A, 96C, and 96E is biased toward one side of second feather seal 92, and the position of cooling holes 96B, 96D, and 96F are biased toward the other side of second feather seal 92. When first feather seal 90 is positioned in a nominal position over second feather seal 92, as shown in FIG. 6, cooling hole 94A extends over a portion of each of cooling holes 96B, 96D, and 96F, and cooling hole 94B extends over a portion of each of cooling holes 96A, 96C, and 96E. Similar to the previously described embodiments of FIGS. 4A-5D, if first feather seal 90 shifts circumferentially or axially relative second feather seal 92, the flow area through holes 94A, 94B, and 96A-96F does not decrease. For example, should first feather seal 90 shift circumferentially such that cooling hole 94A is open to less of cooling holes 96B, 96D, and 96F, cooling hole 94B will shift over cooling holes 96B, 96D, and 96F to compensate while still maintaining the same flow area through cooling holes 96A, 96C, and 96E.

Figure 7:
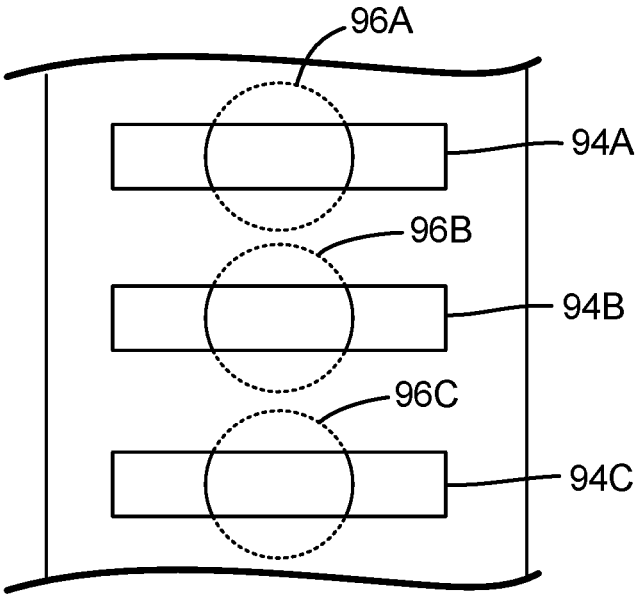
FIG. 7 is a top elevation view of another embodiment of the seal assembly.

FIG. 7 discloses an embodiment where cooling holes 94A-94C for first feather seal 90 are elongated slots that each have a length extending in the direction of the width of first feather seal 90. Cooling holes 96A-96C are circular holes that are positioned under cooling holes 94A-94C respectively.

Figure 8:
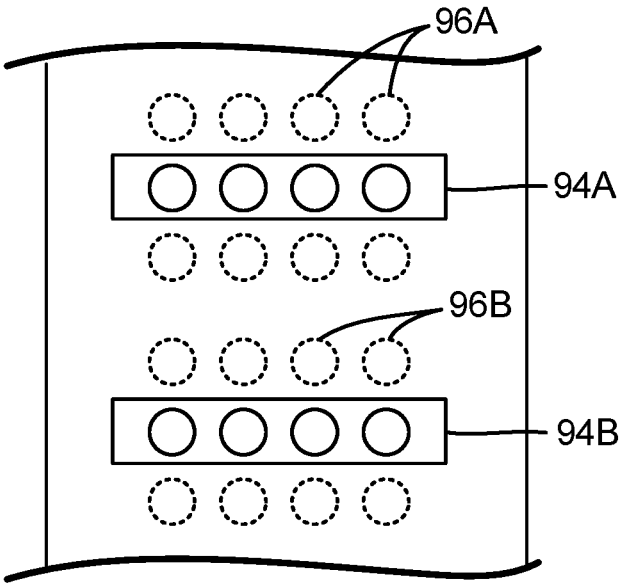
FIG. 8 is a top elevation view of another embodiment of the seal assembly.

FIG. 8 discloses an embodiment where cooling holes 94*a* and 94B are elongated slots that each have a length extending in the direction of the width of first feather seal 90. Second feather seal 92 includes a first plurality of circular cooling holes 96A and a second plurality of circular cooling holes 96B spaced on second feather seal 92 from the first plurality of circular cooling holes 96A. Cooling hole 94A of first feather seal 90 is positioned over a portion of the first plurality of circular cooling holes 96A, and cooling hole 94B is positioned over a portion of the second plurality of circular cooling holes 96B.

Figure 9:
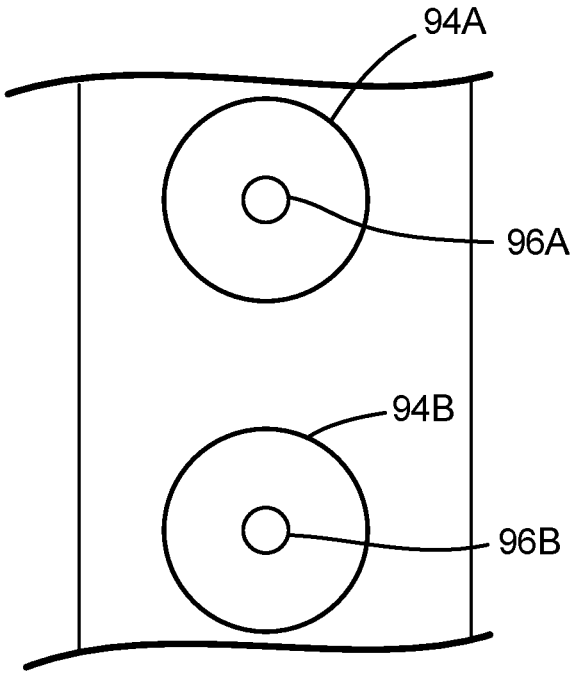
FIG. 9 is a top elevation view of another embodiment of the seal assembly.

FIG. 9 discloses an embodiment of first feather seal 90 with cooling holes 94A and 94B that are both circular cooling holes. Second feather seal 92 includes cooling holes 96A and 96B that are circular holes that are each smaller in diameter than cooling holes 94A and 94B respectively. When first feather seal 90 is positioned nominally over second feather seal 92, cooling hole 94A is concentric with cooling hole 96A, and cooling hole 94B is concentric with cooling hole 96B. Cooling holes 94A and 94B are sufficiently larger in diameter than cooling holes 96A and 96B that cooling holes 96A and 96B are always positioned within the perimeters of cooling holes 94A and 94*b* respectively in the event first feather seal 90 or second feather seal 92 shifts inside channel 86 (shown in FIGS. 2 and 3).

Figure 10:
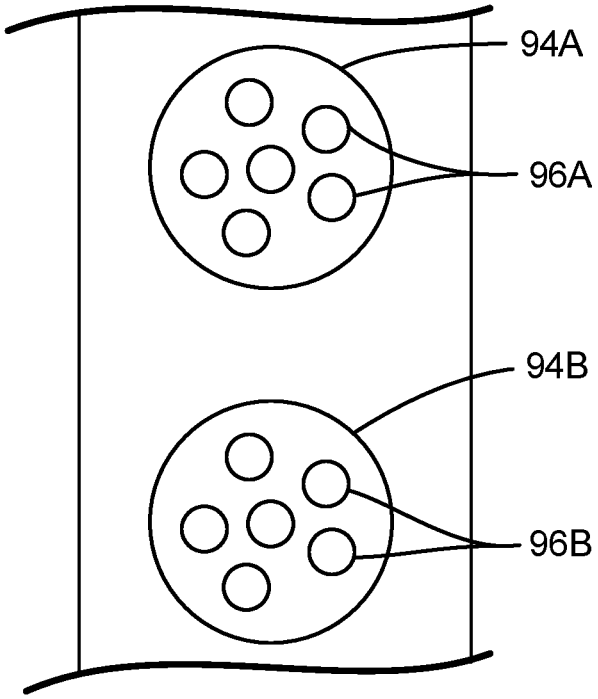
FIG. 10 is a top elevation view of another embodiment of the seal assembly.

FIG. 10 discloses an embodiment of first feather seal 90 with cooling holes 94A and 94B that are both circular cooling holes. Second feather seal 92 includes a first plurality of circular cooling holes 96A and a second plurality of circular cooling holes 96B spaced on second feather seal 92 from the first plurality of circular cooling holes 96A. All of the cooling holes 96A and 96B on second feather seal 92 are significantly smaller in diameter than cooling holes 94A and 94B of first feather seal 90. When first feather seal 90 is positioned nominally over second feather seal 92, cooling hole 94A is positioned over the entire first plurality of circular cooling holes 96A, and cooling hole 94B is positioned over the entire second plurality of circular cooling holes 96B. Cooling holes 94A and 94B are large enough in diameter that the entire first plurality of circular holes 96A and the entire second plurality of cooling holes 96B are always positioned within the perimeters of cooling holes 94A and 94B respectively in the event first feather seal 90 or second feather seal 92 shifts inside channel 86 (shown in FIGS. 2 and 3).

Any relative terms or terms of degree used herein, such as "substantially", "essentially", "generally", "approximately", and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, transitory vibrations and sway movements, temporary alignment or shape variations induced by operational conditions, and the like.

While the invention has been described with reference to an exemplary embodiment(s), it will be understood by those skilled in the art that various changes may be made and equivalents may be substituted for elements thereof without departing from the scope of the invention. For example, while FIGS. 2 and 3 show first feather seal 90 and second feather seal 92 as being used in vane assembly 64, alternatively, first feather seal 90 and second feather seal 92 can be used in BOAS 72. In another example, first feather seal 90 and second feather seal 92 can be used between platforms of two rotor blades. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A seal assembly for a gas turbine engine comprises: a first feather seal comprising a first cooling hole extending through the first feather seal: and a second feather seal adjacent to the first feather seal, wherein the second feather seal comprises a second cooling hole extending through the second feather seal, a third cooling hole extending through the second feather seal, and a fourth cooling hole extending through the second feather seal, wherein the first cooling hole extends over at least a portion of the second, third, and fourth cooling holes, and wherein a perimeter of the first cooling hole is larger than a perimeter of each of the second, third, and fourth cooling holes.

2. The assembly of claim 1, wherein the first cooling hole is an elongated slot.

3. The assembly of claim 2, wherein the second, third, and fourth cooling holes are each an elongated slot that is non-parallel with the first cooling hole.

4. The assembly of claim 2, wherein the second cooling hole is a circular hole.

5. The assembly of claim 1, wherein the first cooling hole is a circular hole and the second cooling hole, the third cooling hole, and the fourth cooling hole are each a circular hole with a smaller diameter than the first cooling hole.

6. The assembly of claim 2, wherein the second cooling hole, the third cooling hole, and the fourth cooling hole are each a circular hole.

* * * * *